US007523928B2

(12) United States Patent
Chen

(10) Patent No.: US 7,523,928 B2
(45) Date of Patent: Apr. 28, 2009

(54) PAPER-FEEDING SYSTEM CAPABLE OF SWITCHING PAPER-FEEDING STATUSES

(75) Inventor: Chien-Chih Chen, Taipei Hsien (TW)

(73) Assignee: Qisda Corporation, Taoyuan County (TW)

( * ) Notice: Subject to any disclaimer, the term of this patent is extended or adjusted under 35 U.S.C. 154(b) by 146 days.

(21) Appl. No.: 11/557,978

(22) Filed: Nov. 9, 2006

(65) Prior Publication Data

US 2007/0104529 A1 May 10, 2007

(30) Foreign Application Priority Data

Nov. 10, 2005 (TW) ..... 94139402 A

(51) Int. Cl.
*B65H 3/06* (2006.01)

(52) U.S. Cl. ..... 271/117; 271/118; 271/257; 271/256; 271/157

(58) Field of Classification Search ..... 271/117, 271/157
See application file for complete search history.

(56) References Cited

U.S. PATENT DOCUMENTS 3,588,106 A * 6/1971 Csaba et al. ..... 271/170
5,709,380 A * 1/1998 Petocchi et al. ..... 271/125
6,651,972 B2 * 11/2003 Hsiao et al. ..... 271/114
6,783,126 B2 * 8/2004 Amamoto ..... 271/152
2005/0110206 A1 * 5/2005 Hsieh ..... 271/117
2007/0001375 A1 * 1/2007 Zhu ..... 271/117

FOREIGN PATENT DOCUMENTS

JP 55052832 A * 4/1980
JP 2005132520 A * 5/2005

* cited by examiner

*Primary Examiner*—Patrick H Mackey
*Assistant Examiner*—Luis Gonzalez

(57) ABSTRACT

A paper-feeding system includes a paper tray for positioning a print medium, a pickup roller installed in front of the paper tray for picking up the print medium, a pickup arm connected to the pickup roller including a first retainer, a first elastic component connected to the pickup arm for providing an elastic force to the pickup arm so that the pickup roller can press the print medium, and a swing arm fixed to a shaft at one end. The swing arm includes a second retainer installed at the other end for fixing the first retainer.

9 Claims, 10 Drawing Sheets

PAPER-FEEDING SYSTEM CAPABLE OF SWITCHING PAPER-FEEDING STATUSES

BACKGROUND OF THE INVENTION

1. Field of the Invention

The present invention relates to a paper-feeding system, and more particularly, to a paper-feeding system capable of switching paper-feeding statuses manually or automatically.

2. Description of the Prior Art

Please refer to FIG. 1. FIG. 1 is a diagram of a paper-feeding system 10 in the prior art. The paper-feeding system 10 includes a paper tray 12 for positioning a print medium 14, such as paper or a transparency, a burster 16 installed below the paper tray 12, a pickup arm 18, and a pickup roller 20. One end of the pickup arm 18 is connected to the pickup roller 20, and the other end of the pickup arm 18 is applied a force by an elastic component (not shown in FIG. 1) so that the pickup roller 20 is capable of applying a normal force to the print medium 14. The pickup arm 18 keeps pressing the print medium 14 so that the pickup roller 20 can press an upper surface of the print medium 14 steady.

Please refer to FIG. 2 and FIG. 3. FIG. 2 is a lateral view of the paper-feeding system 10 when print media are loaded fully in the prior art. FIG. 3 is a lateral view of the paper-feeding system 10 when no print medium is loaded in the prior art. The pickup roller 20 continues pressing the upper surface of the print medium 14 so as to apply the normal force to the print medium 14 for generating a corresponding friction force to drive the print medium 14 to move downward. The burster 16 blocks a bottom of the print medium 14 so that the print medium 14 buckles. The upper print medium 14 can be separated from other print media alone.

Because the pickup roller 20 needs to continue pressing the upper surface of the print medium so as to provide a normal force to the print medium 14, the normal force has to be overcome when positioning the print medium 14 inside the paper-feeding system 10 at a correct location. When the print medium 14 is loaded improperly, the print medium 14 might enter to a print area incorrectly. In addition, the normal force increases difficulty of repairing a paper jam of the paper-feeding system 10.

SUMMARY OF THE INVENTION

It is therefore a primary objective of the claimed invention to provide a paper-feeding system capable of switching paper-feeding statuses manually or automatically for solving the above-mentioned problem.

According to the claimed invention, a paper-feeding system includes a paper tray for positioning a print medium, a pickup roller installed in front of the paper tray for picking up the print medium, a pickup arm connected to the pickup roller including a first retainer, a first elastic component connected to the pickup arm for providing an elastic force to the pickup arm so that the pickup roller can press the print medium, and a swing arm fixed to a shaft at one end. The swing arm includes a second retainer installed at the other end for fixing the first retainer.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
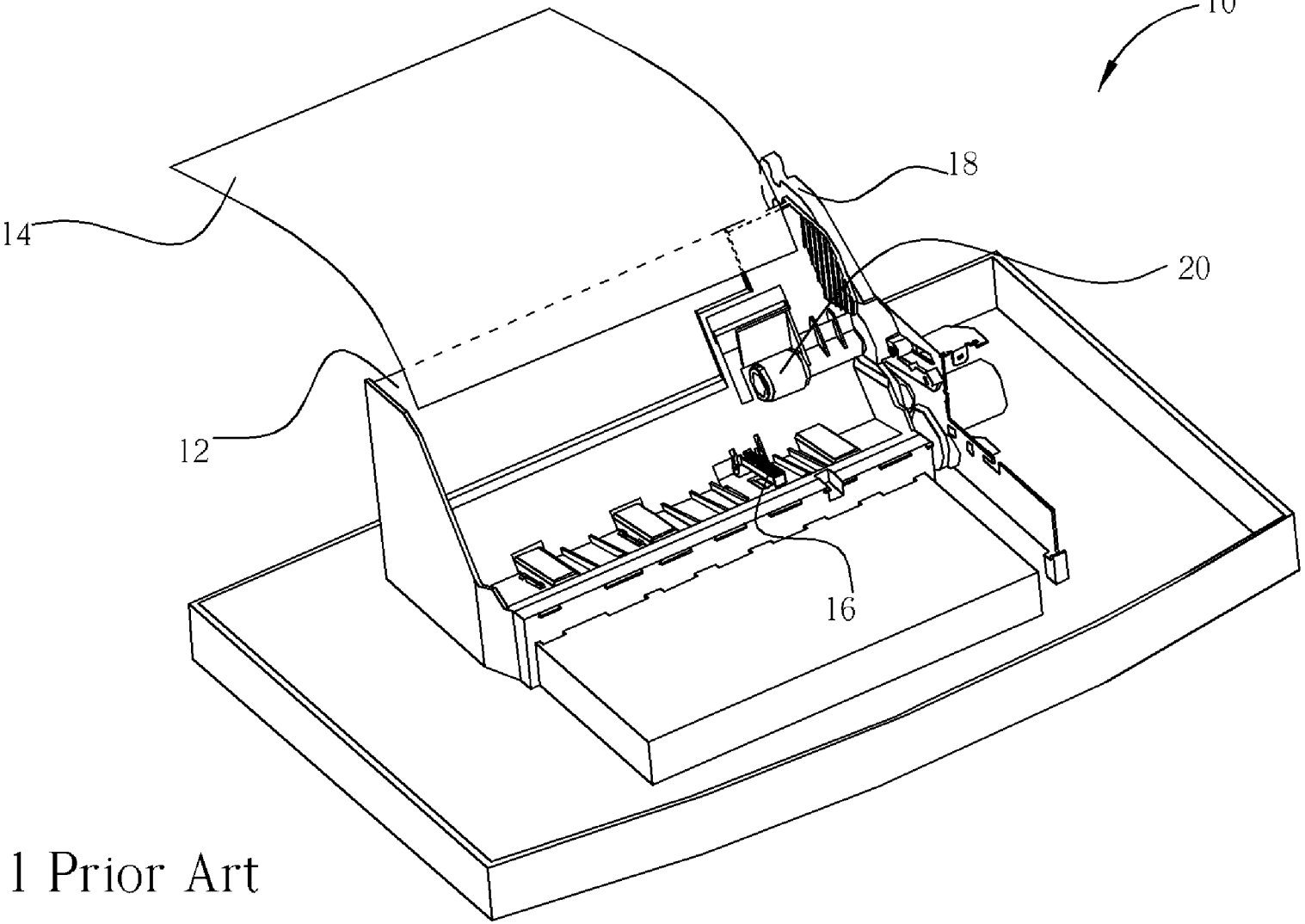
Fig. 1 Prior Art
FIG. 1 is a diagram of a paper-feeding system in the prior art.
Figure 2:
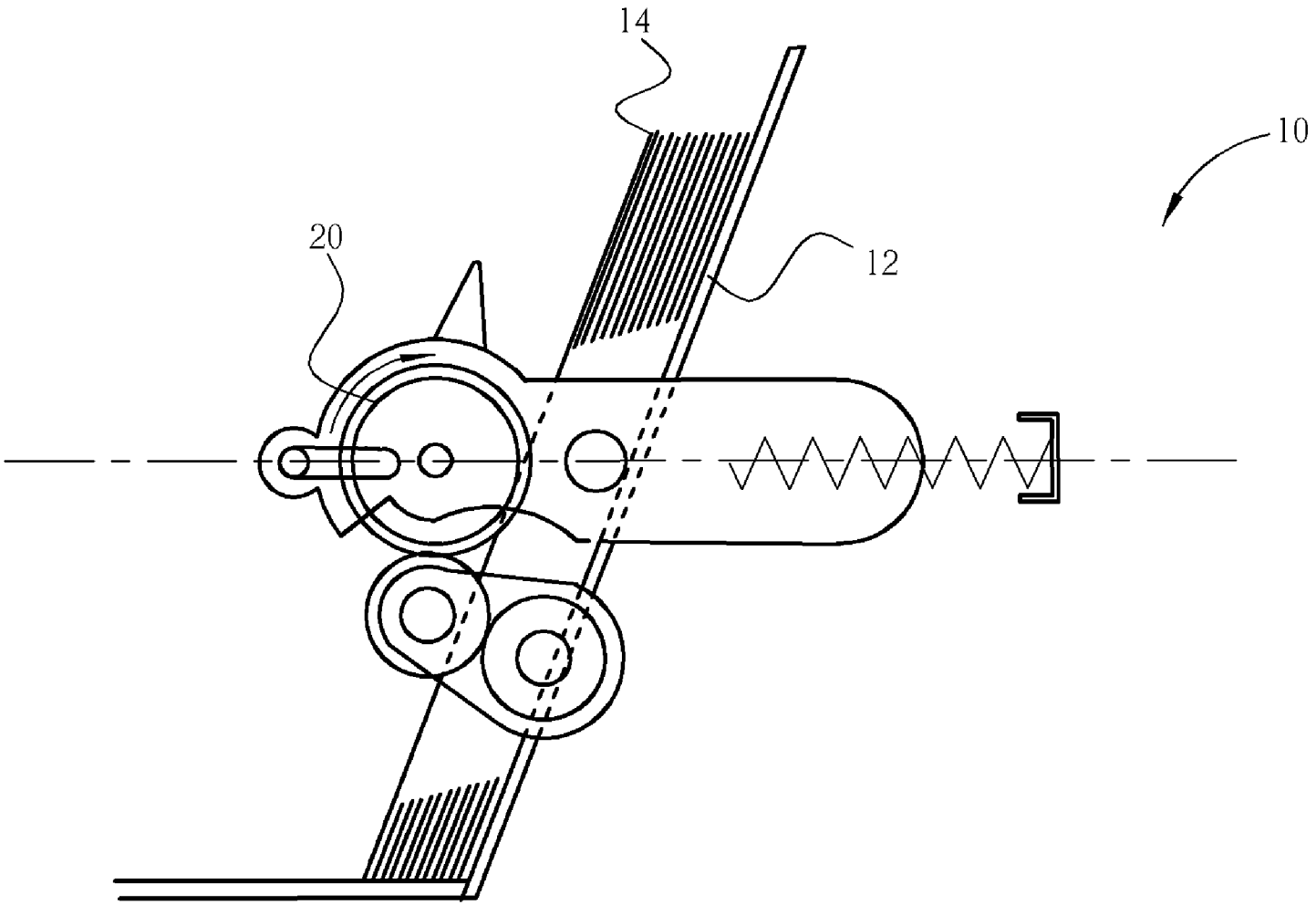
Fig. 2 Prior Art
FIG. 2 is a lateral view of the paper-feeding system shown in FIG. 1 when print media are loaded fully in the prior art.
Figure 3:
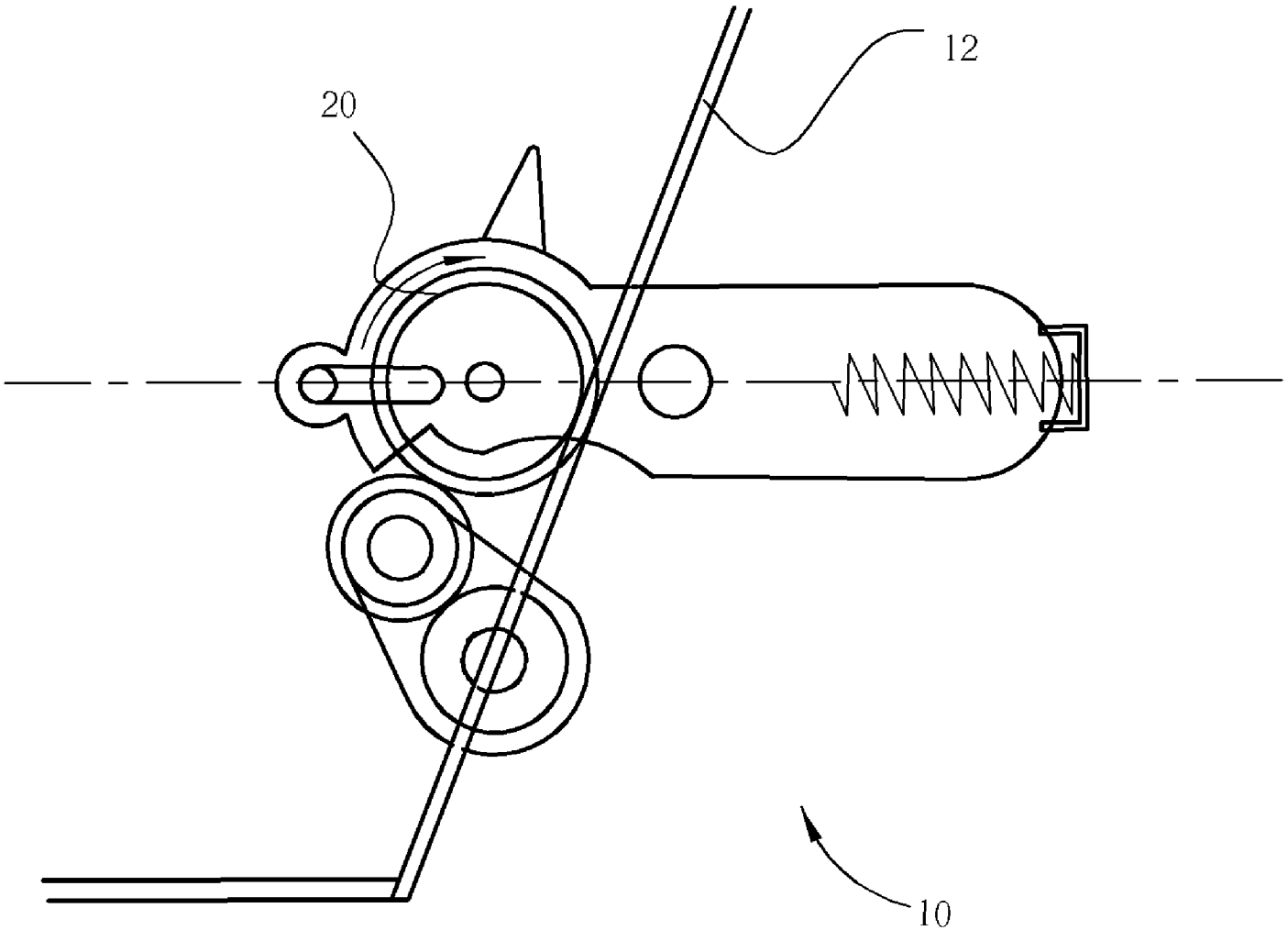
Fig. 3 Prior Art
FIG. 3 is a lateral view of the paper-feeding system shown in FIG. 1 when no print medium is loaded in the prior art.
Figure 4:
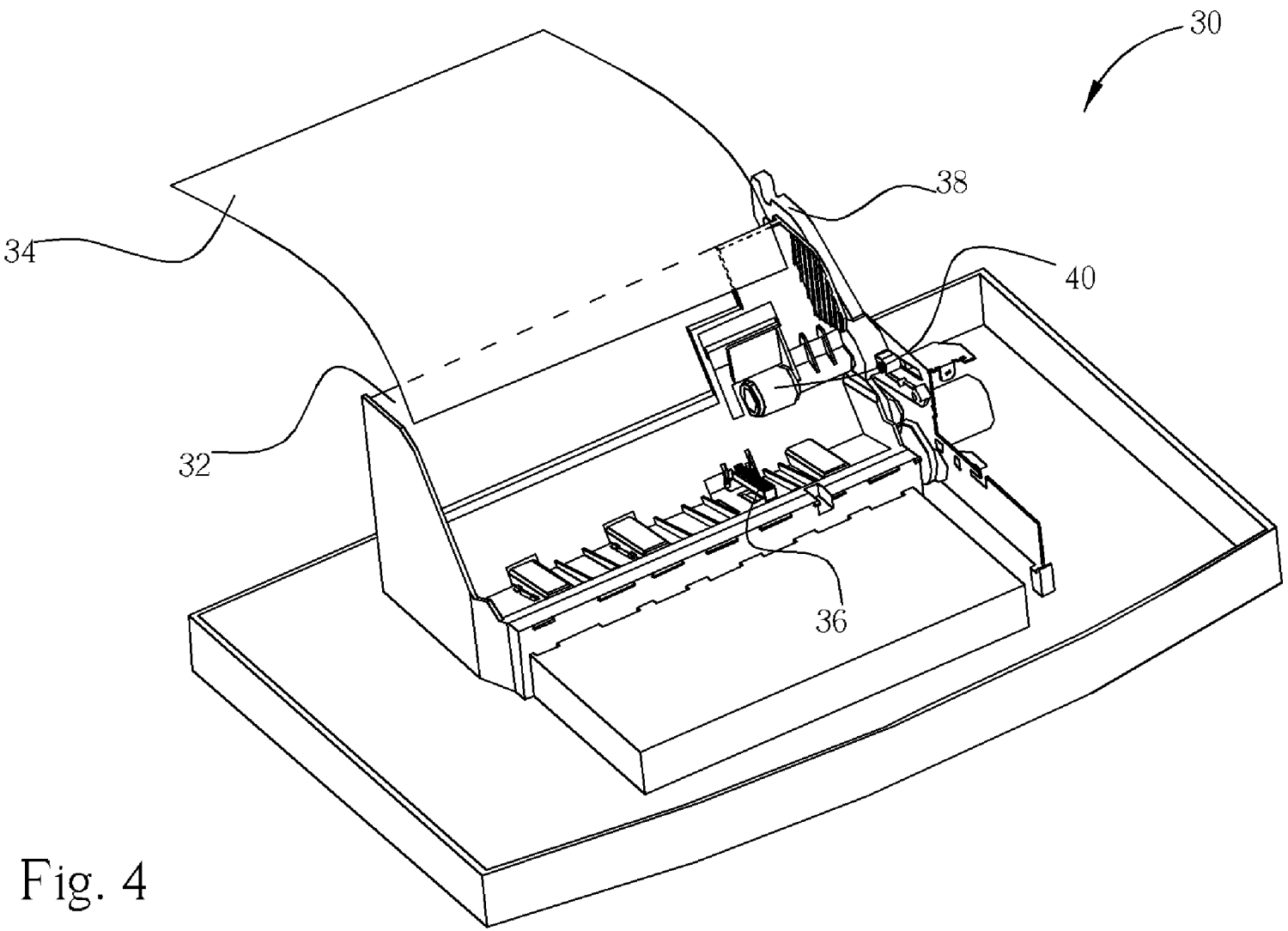
FIG. 4 is a diagram of a paper-feeding system according to the present invention.

Please refer to FIG. 4. FIG. 4 is a diagram of a paper-feeding system 30 according to the present invention. The paper-feeding system 30 includes a paper tray 32 for positioning a print medium 34, such as paper or a transparency, a burster 36 installed below the paper tray 32 for blocking a bottom of the print medium 34 so that the print medium 34 buckles when the print medium 34 moves downward, a pickup arm 38, and a pickup roller 40 installed in front of the paper tray 32 for picking up the print medium 34. One end of the pickup arm 38 is connected to the pickup roller 40, and the other end of the pickup arm 38 is applied a force by an elastic component (not shown in FIG. 4) so that the pickup roller 40 is capable of applying a normal force to the print medium 34. The pickup arm 38 keeps pressing the print medium 34 so that the pickup roller 40 can press an upper surface of the print medium 34 steady. The pickup roller 40 continues pressing the upper surface of the print medium 34 so as to provide the normal force to the print medium 34 for generating a corresponding friction force to drive the print medium 34 to move downward. The burster 36 blocks the bottom of the print medium 34 so that the print medium 34 buckles. The upper print medium 34 can be separated from other print media alone.

Figure 5:
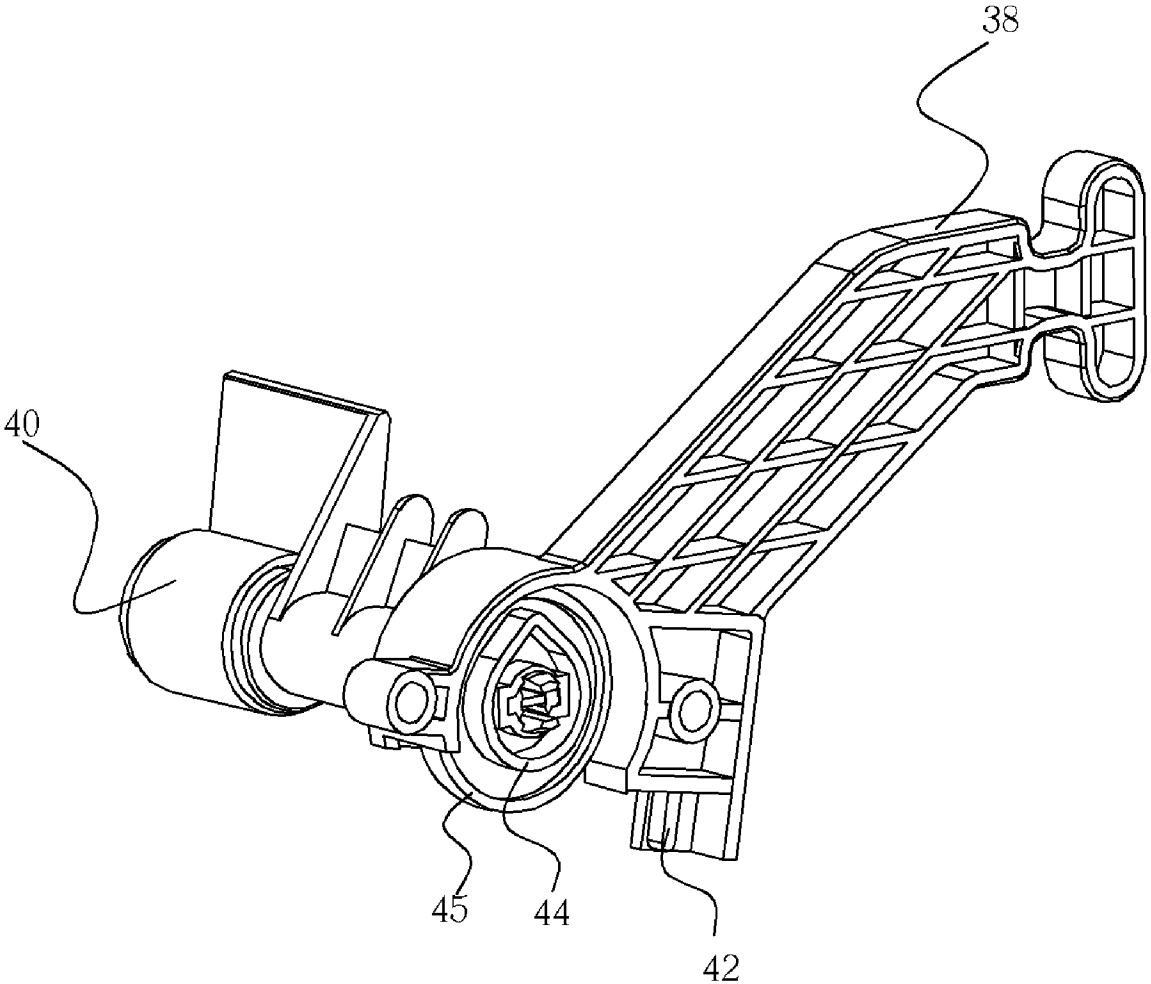
FIG. 5 is a schematic drawing of a pickup arm and a pickup roller according to the present invention.
Figure 6:
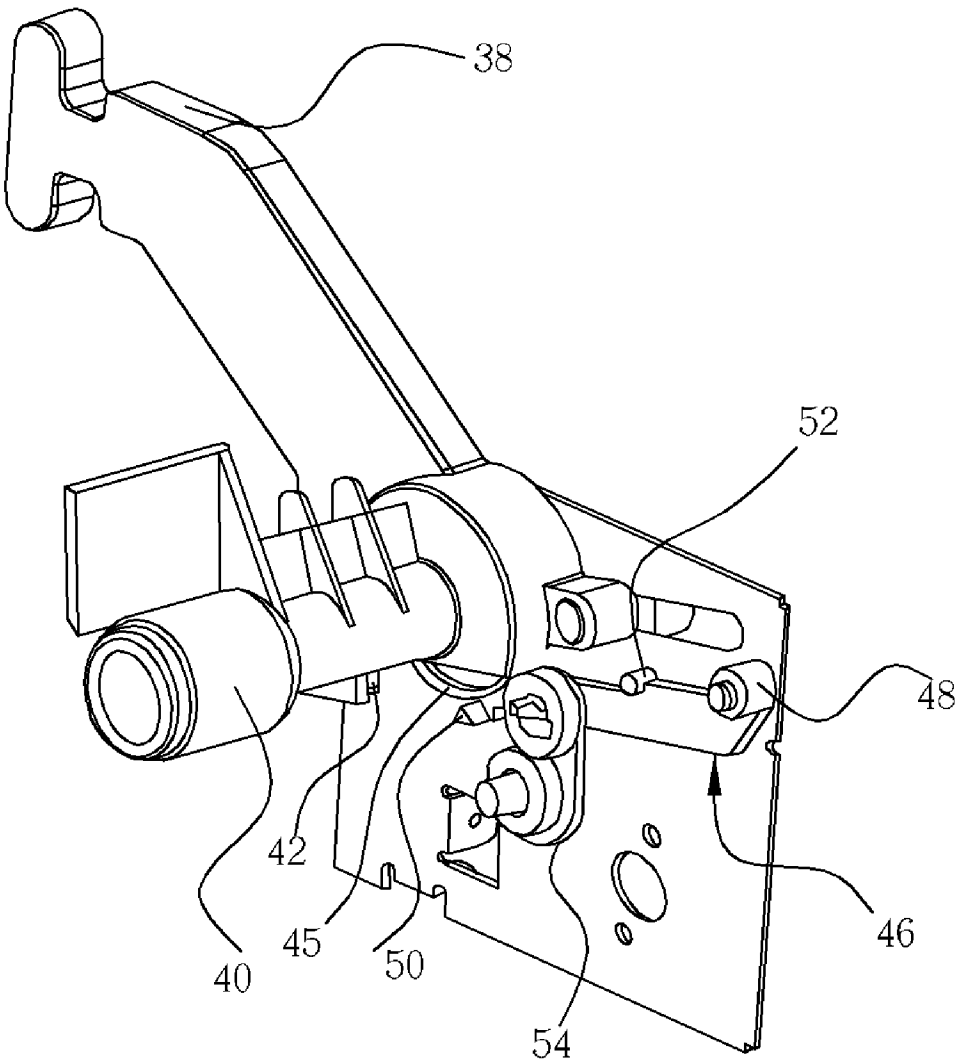
FIG. 6 is a relative position diagram of the pickup arm shown in FIG. 5 and other components according to the present invention.

Please refer to FIG. 5 and FIG. 6. FIG. 5 is a schematic drawing of the pickup arm 38 and the pickup roller 40 according to the present invention. FIG. 6 is a relative position diagram of the pickup arm 38 and other components according to the present invention. As shown in FIG. 5, the pickup arm 38 includes a first retainer 42. The paper-feeding system 30 further includes a cam 44 installed inside a gear 45. As shown in FIG. 6, the paper-feeding system 30 further includes a swing arm 46 fixed a shaft 48 at one end. The swing arm 46 includes a second retainer 50 installed at the other end for fixing the first retainer 42. The swing arm 46 further includes a protruding structure 52 for being pushed by the cam 44 when touching a protruding part of the cam 44. The paper-feeding system 30 further includes a power supply device 54 for supplying rotation power to the pickup roller 40 and the cam 44.

Figure 7:
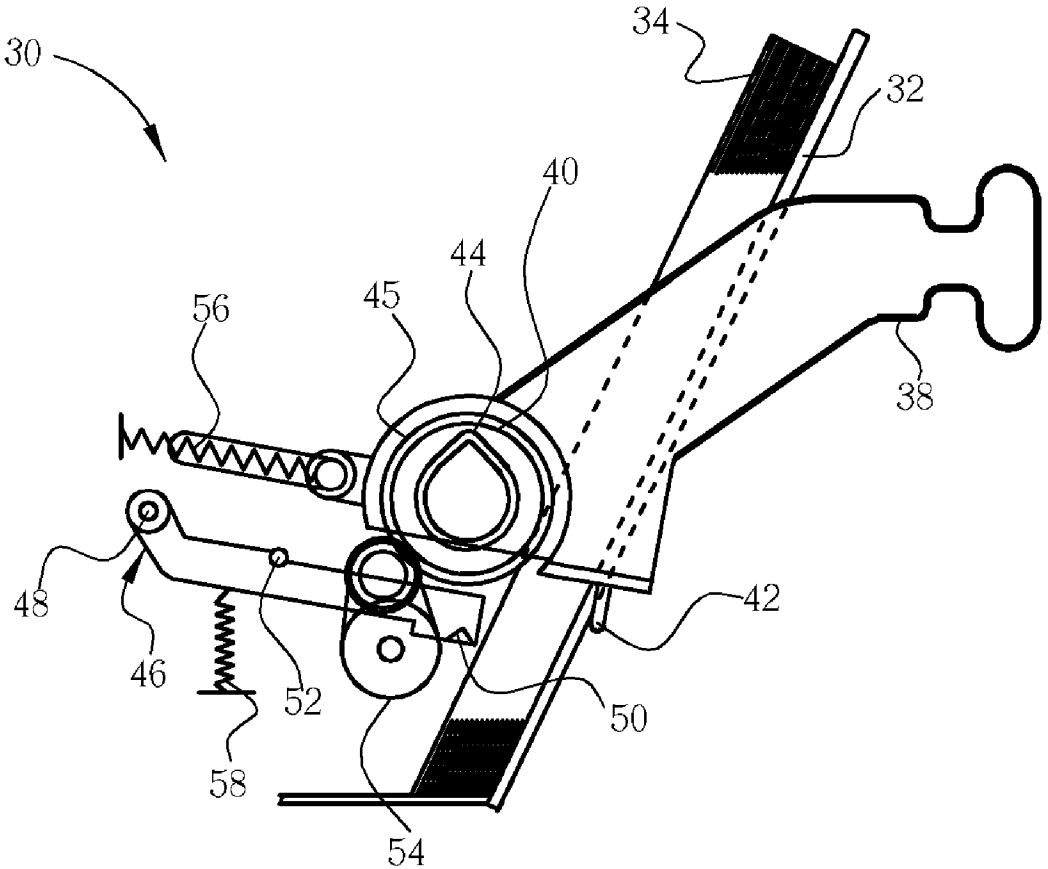
FIG. 7 is a lateral view of the pickup roller shown in FIG. 5 pressing a print medium closely according to the present invention.
Figure 8:
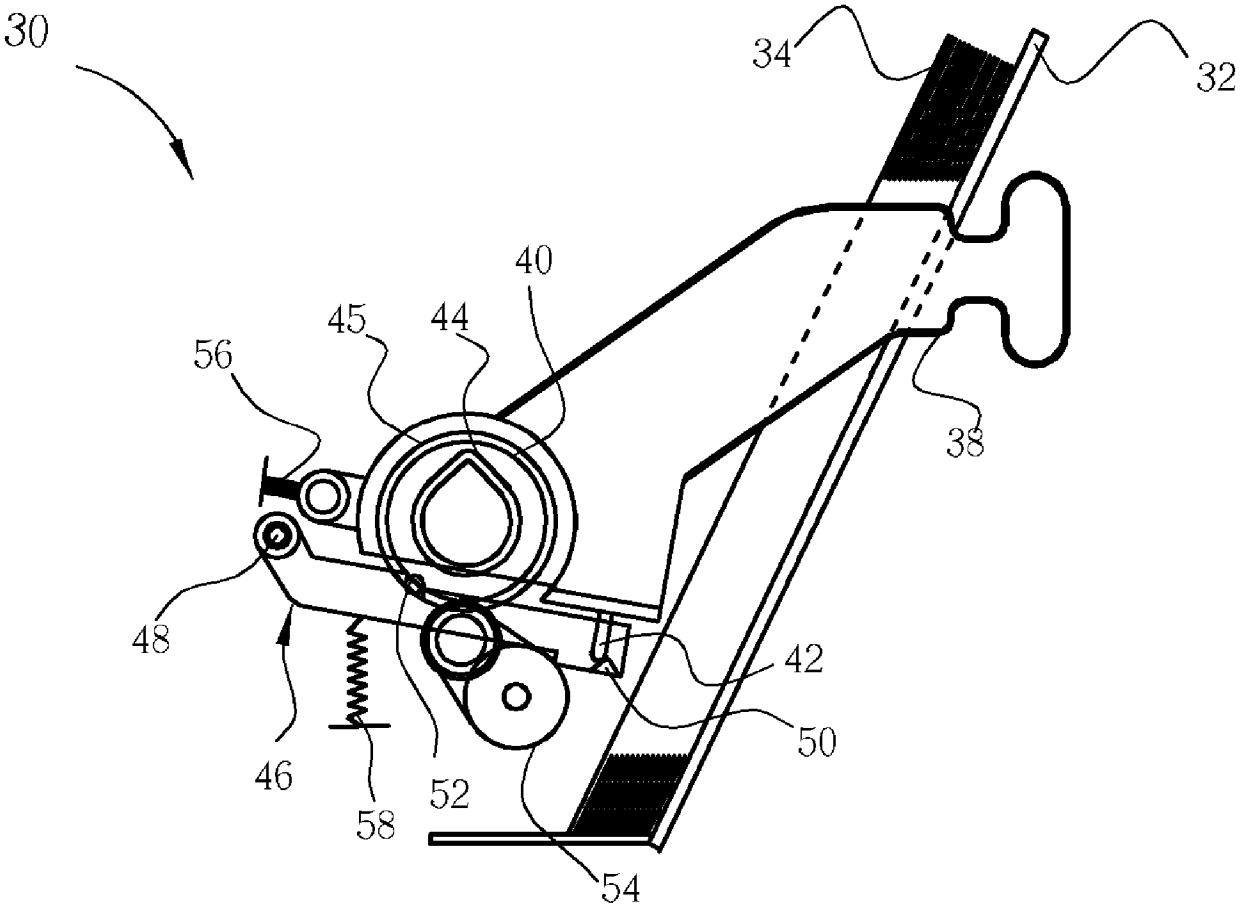
FIG. 8 is a lateral view of separating the pickup roller from the print medium manually according to the present invention.

Please refer to FIG. 7 and FIG. 8. FIG. 7 is a lateral view of the pickup roller 40 pressing the print medium 34 closely according to the present invention. FIG. 8 is a lateral view of separating the pickup roller 40 from the print medium 34 manually according to the present invention. The paper-feeding system 30 further includes a first elastic component 56 connected to the pickup arm 38 for providing an elastic force to the pickup arm 38 so that the pickup roller 40 can press the print medium 34. The first elastic component 56 can be a tensional spring or a torque spring. The paper-feeding system 30 further includes a second elastic component 58 connected to the swing arm 46 for providing an elastic force to the swing arm 46. The second elastic component 58 can be a tensional spring or a torque spring. As shown in FIG. 7, the first elastic component applies the elastic force to the pickup arm 38 so that the pickup roller 40 can press the print medium 34. Although the amount of print media positioned above the paper tray 32 might change, the pickup arm 38 can continue pressing the print medium 34 closely so that the pickup roller 40 can press the upper surface of the print medium 34 steady. A distance between the pickup 40 and the paper tray 32 is adjusted by the elastic force provided by the first elastic component 56 dynamically according to the thickness of print media positioned above the paper tray 32. The movable range of the swing arm 38 is greater than the thickness change of print media in a full-loading situation and an empty situation of the paper-feeding system 30.

Please refer to FIG. 7, the pickup roller 40 presses the upper surface of the print medium 34 so as to provide the normal force to the print medium 34 for generating a corresponding friction force to drive the print medium 34 to move downward. The power supply device 54 drives the gear 45 to rotate. The gear 45, the cam 44, and the pickup roller 40 are designed to be connected in a same shaft. When the gear 45 rotates, the cam 44 and the pickup roller 40 are driven to rotate simultaneously so that the pickup roller 40 drives the print medium 34 to move downward to the burster 36.

Please refer to FIG. 8, when reloading the print medium 34 or repairing a paper jam of the paper-feeding system 30, the swing arm 38 can be separated from the print medium 34 manually. At the same time, the first retainer 42 of the pickup arm 38 pushes forward the second retainer 50 of the swing arm 46 so that the swing arm 46 rotates clockwise relative to the shaft 48 until the first retainer 42 of the swing arm 38 passes through the second retainer 50 of the swing arm 46. After the first retainer 42 of the swing arm 38 passes through the second retainer 50 of the swing arm 46, the swing arm 46 returns to an original position by the elastic force provided by the second elastic component 58. The second retainer 50 can fix the first retainer 42 so that the swing arm 38 can not return to a position shown in FIG. 7. The pickup roller 40 does not press the upper surface of the print medium 34, and the user can supply the print medium 34 or repair the paper jam. When the user finishes supplying the print medium 34 or repairing the paper jam, the user can push the pickup arm 38 in an opposite direction to the position shown in FIG. 7.

Figure 9:
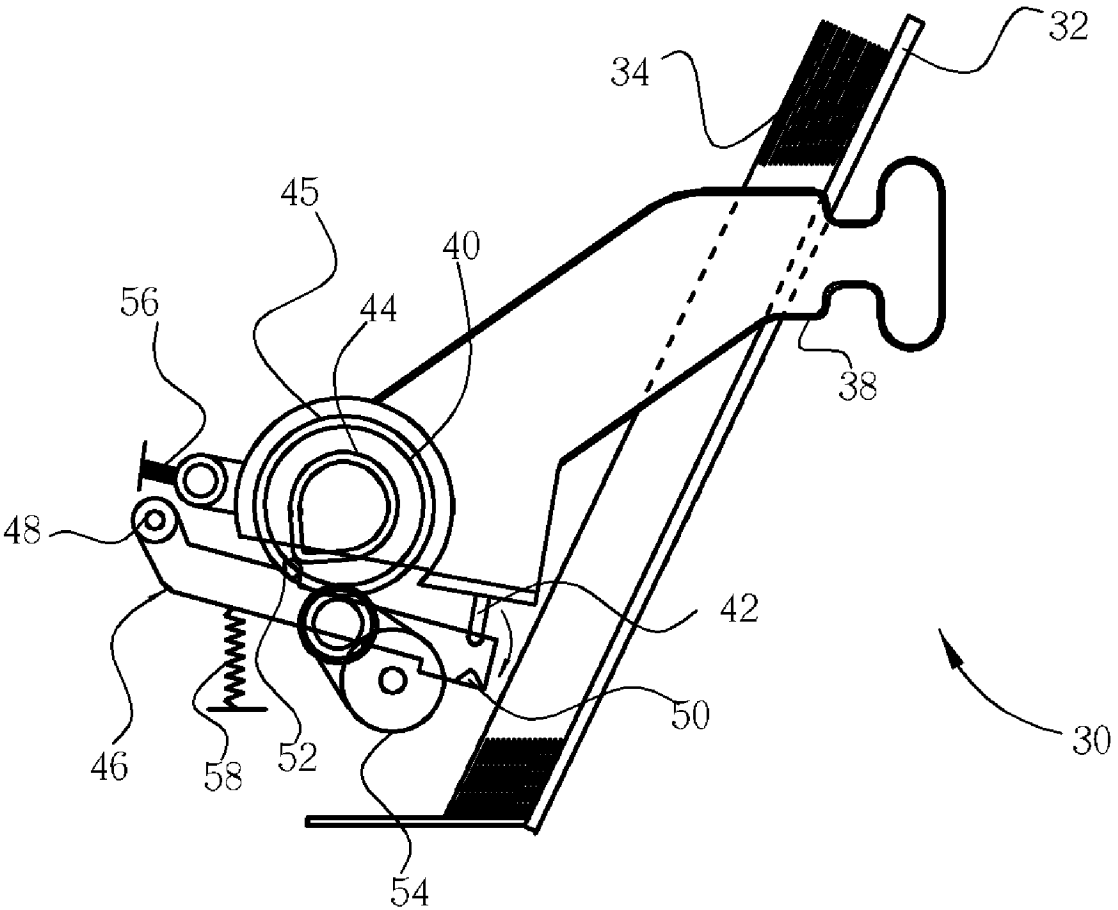
FIG. 9 is a lateral view of the pickup arm driven to press the print medium automatically according to the present invention.

The present invention can be designed that the pickup arm 38 returns to the position shown in FIG. 7 from the position shown in FIG. 8 by the power supply device 54 automatically when the power supply device 54 is activated to pick up the print medium 54. It can solve the problem that the user forgets to push the pickup arm 38 to the original position manually after the user finishes supplying the print medium 34 or repairing the paper jam. Please refer to FIG. 9. FIG. 9 is a lateral view of the pickup arm 38 driven to press the print medium 34 automatically according to the present invention. When the power supply device 54 drives the gear 45 to rotate so as to drive the pickup roller 40 for picking up the print medium 34, the cam 44 is driven to rotate simultaneously. The protruding part of the cam 44 rotates to push the protruding structure 52 of the swing arm 46 so that the swing arm 46 rotates clockwise relative to the shaft 48. At the same time the second retainer 50 can not constrain the first retainer 42, and the pickup arm 38 can be pushed to the original position shown in FIG. 7 by the elastic force provided by the first elastic component 56.

Figure 10:
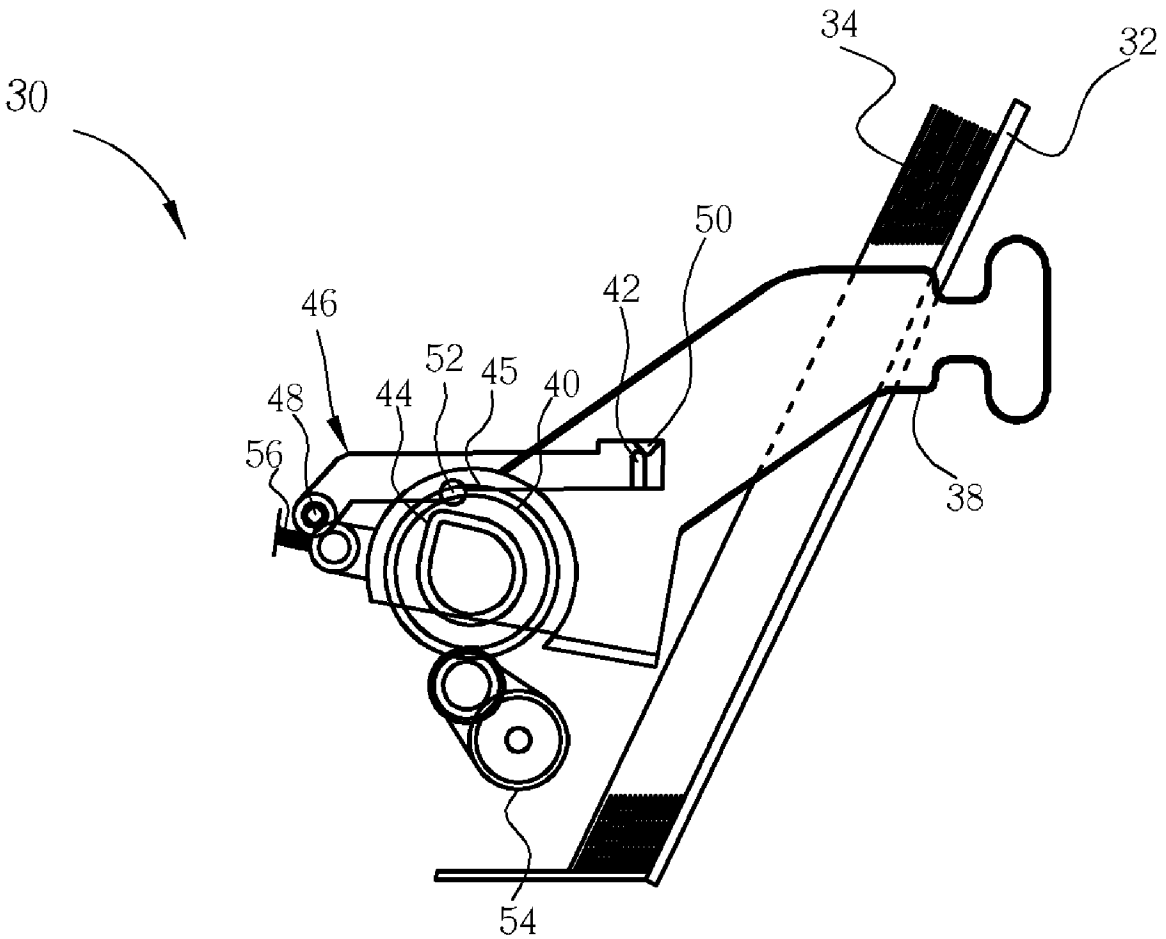
FIG. 10 is a lateral view of a swing arm returning to the original position by the gravity force instead of the elastic force provided by a second elastic component of another embodiment according to the present invention.

The present invention can be designed that the swing arm 46 returns to the original position with the gravity force by adjusting a position of the swing arm 46. Please refer to FIG. 10. FIG. 10 is a lateral view of the swing arm 46 returning to the original position by the gravity force instead of the elastic force provided by the second elastic component 58 of another embodiment according to the present invention. The difference between the above-mentioned embodiment and this embodiment is that there is no need to utilize the second elastic component 58 in this embodiment. In addition, the swing arm 46 is installed above the pickup roller 40 and the first retainer 42 is installed at an upper position of the pickup arm 38. The first retainer 42 is installed below the second retainer 50. When reloading the print medium 34 or repairing a paper jam, the swing arm 38 can be separated from the print medium 34 manually. At the same time, the first retainer 42 of the pickup arm 38 pushes forward the second retainer 50 of the swing arm 46 so that the swing arm 46 rotates counter-clockwise relative to the shaft 48 until the first retainer 42 of the swing arm 38 passes through the second retainer 50 of the swing arm 46. After the first retainer 42 of the swing arm 38 passes through the second retainer 50 of the swing arm 46, the swing arm 46 returns to the original position by the gravity force of its own. The second retainer 50 can fix the first retainer 42 so that the swing arm 38 can not return to the original position. The pickup roller 40 does not press the upper surface of the print medium 34, and the user can supply the print medium 34 or repair the paper jam. When the user finishes supplying the print medium 34 or repairing the paper jam, the user can push the pickup arm 38 in an opposite direction to the original position.

In contrast to the conventional paper-feeding system, the paper-feeding system according to the present invention can separate the pickup roller from the upper surface of the print medium when the user supplies the print medium or repairs the paper jam. It can improve the disadvantage that the normal force has to be overcome when positioning the print medium inside the paper-feeding system at a correct location. In addition, it can prevent that the print medium might enter to a print area incorrectly when the print medium is loaded improperly and reduce the difficulty of repairing the paper jam of the paper-feeding system due to the normal force. The present invention can be designed that the pickup arm returns to the position of pressing the print medium closely automatically so as to prevent that the user forgets to push the pickup arm to the original position manually after the user finishes supplying the print medium or repairing the paper jam.

Those skilled in the art will readily observe that numerous modifications and alterations of the device and method may be made while retaining the teachings of the invention.

Accordingly, the above disclosure should be construed as limited only by the metes and bounds of the appended claims.

What is claimed is:

1. A paper-feeding system comprising:

a paper tray for positioning a print medium;

a pickup roller installed in front of the paper tray for picking up the print medium;

a pickup arm connected to the pickup roller comprising a first retainer;

a first elastic component connected to the pickup arm for providing an elastic force to the pickup arm so that the pickup roller can press the print medium;

a swing arm fixed to a shaft at one end, the swing arm comprising a second retainer installed at the other end for fixing the first retainer; and a cam for driving the swing arm to rotate relative to the shaft so as to separate the second retainer from the first retainer.

2. The paper-feeding system of claim 1 wherein the swing arm comprises a protruding structure for being pushed by the cam when touching a protruding part of the cam.

3. The paper-feeding system of claim 1 further comprising a power supply device for supplying rotation power to the pickup roller and the cam.

4. The paper-feeding system of claim 1 further comprising a second elastic component connected to the swing arm for providing an elastic force to the swing arm.

5. The paper-feeding system of claim 4 wherein the second elastic component is a tensional spring.

6. The paper-feeding system of claim 4 wherein the second elastic component is a torque spring.

7. The paper-feeding system of claim 1 further comprising a burster for blocking a bottom of the print medium so that the print medium buckles when the pickup roller picks up the print medium downward.

8. The paper-feeding system of claim 1 wherein the first elastic component is a tensional spring.

9. The paper-feeding system of claim 1 wherein the first elastic component is a torque spring.

* * * * *